US005201207A

United States Patent [19]

Organi et al.

[11] Patent Number: 5,201,207

[45] Date of Patent: Apr. 13, 1993

[54] METHOD OF MANUFACTURING A THIMBLE OF CONTACT FINGERS, AND A THIMBLE MADE BY THE METHOD

[75] Inventors: Henri Organi; Roger Sauvat, both of Villeurbanne, France

[73] Assignee: GEC Alsthom SA, Paris, France

[21] Appl. No.: 880,007

[22] Filed: May 8, 1992

[30] Foreign Application Priority Data

May 30, 1991 [FR] France ..... 91 06522

[51] Int. Cl.[5] ..... B21D 22/10

[52] U.S. Cl. ..... 72/60; 72/57; 72/465

[58] Field of Search ..... 72/54, 56, 58, 59, 60; 72/61, 62, 465, 57; 29/421.1

[56] References Cited

U.S. PATENT DOCUMENTS

| | | | |
|---|---|---|---|
| 2,375,574 | 5/1945 | Methony et al. | 72/60 |
| 3,440,705 | 4/1969 | Johnson | 72/62 |
| 3,564,884 | 2/1971 | Hinshaw | 72/57 |
| 4,111,024 | 9/1978 | Dahlman et al. | 72/60 |
| 4,723,430 | 2/1988 | Hahn | 72/54 |

FOREIGN PATENT DOCUMENTS

| | | | |
|---|---|---|---|
| 1133961 | 11/1956 | France . | |
| 2302581 | 9/1976 | France . | |
| 1166861 | 7/1985 | U.S.S.R. | 72/62 |

*Primary Examiner*—David Jones
*Attorney, Agent, or Firm*—Sughrue, Mion, Zinn, Macpeak & Seas

[57] ABSTRACT

A method of manufacturing a thimble of contact fingers from a blank constituted by a tube of material having good conductive properties and good elasticity, the tube including a thin-walled portion provided with longitudinal parallel slots and terminated by a ring of material having good electrical conductivity and that is good at withstanding the effects of electrical arcing, wherein the method comprises the following operations: the said blank is placed around a cylindrical core of diameter substantially equal to the diameter of the blank and of length equal to the length of the blank, the end of the core coming into abutment against the ring; an annular section block is disposed around the blank over the slots, the inside diameter of the block being close to and slightly greater than the outside diameter of the blank and the axial length of the block being substantially equal to the axial length of the slots, the block being made of an elastomer material; and pressure is exerted on the end surfaces of said block, thereby tending to reduce the inside diameter of said block until the desired slot width is obtained.

4 Claims, 2 Drawing Sheets

METHOD OF MANUFACTURING A THIMBLE OF CONTACT FINGERS, AND A THIMBLE MADE BY THE METHOD

The present invention relates to a method of manufacturing a thimble of contact fingers, suitable for equipping electrical apparatuses such as circuit breakers and section switches.

BACKGROUND OF THE INVENTION

Thimbles of contact fingers are conventionally manufactured as follows: the starting material is a tube made of a metal that is a good conductor of electricity and that has good properties of resilience, for example and alloy of copper including chromium. One of the ends of the tube is provided with a ring of cupro-tungsten for use in making the contact tips of the fingers. The ring is made by electron bombardment or by brazing.

Parallel longitudinal slots are formed through the ring and along a portion of the tube so as to constitute contact fingers. At present, the cheapest method of making the slots is to perform milling passes; however, that method is unsuitable for making slots that are narrower than 1.2 mm, whereas thimbles of contact fingers in gas blast circuit breakers require the slots to be only about 0.2 mm wide so that the blast gas can be compressed sufficiently. It might be thought that the fingers could be separated by machining using a wire, however although such a method is suitable for obtaining slot widths of the desired narrowness, it suffers from the severe drawback of being lengthy and expensive. The present procedure is therefore to take a tube having wide slots and then to perform an upsetting operation on a lathe until the slots have been narrowed to the desired width. Unfortunately, this operation suffers from the defect of work hardening the metal, thereby causing it to lose a portion of its strength and resilience.

An object of the invention is to provide a method enabling the end of the tube to be swaged without spoiling the qualities of the metal.

SUMMARY OF THE INVENTION

The invention thus provides a method of manufacturing a thimble of contact fingers from a blank constituted by a tube of material having good conductive properties and good elasticity, the tube including a thin-walled portion provided with longitudinal parallel slots and terminated by a ring of material having good electrical conductivity and that is good at withstanding the effects of electrical arcing, wherein the method comprises the following operations:

the said blank is placed around a cylindrical core of diameter substantially equal to the diameter of the bland and of length equal to the length of the blank, the end of the core coming into abutment against the ring;

an annular section block is disposed around the blank over the slots, the inside diameter of the block being close to and slightly greater than the outside diameter of the blank and the axial length of the block being substantially equal to the axial length of the slots, the block being made of an elastomer material; and pressure is exerted on the end surfaces of said block, thereby tending to reduce the inside diameter of said block until the desired slot width is obtained.

Advantageously, the method is performed by means of a press comprising a fixed sheath provided with a cylindrical recess for receiving the elastomer block and a bore for receiving a centering part for centering the blank, and a moving top block to which said cylindrical core is fixed, the top block being associated with means for receiving pressure which is communicated via a thrust washes to the block of elastomer material.

Advantageously, a spacer is disposed between the sheath and the moving block to limit the stroke of the moving block.

Advantageously, the elastomer material of the block is the material sold under the trademark Eladip and the reference E 420, having a hardness of 81 on the Shore A scale.

BRIEF DESCRIPTION OF THE DRAWINGS

An embodiment of the invention is described by way of example with reference to the accompanying drawings, in which.

DETAILED DESCRIPTION

Figure 1:
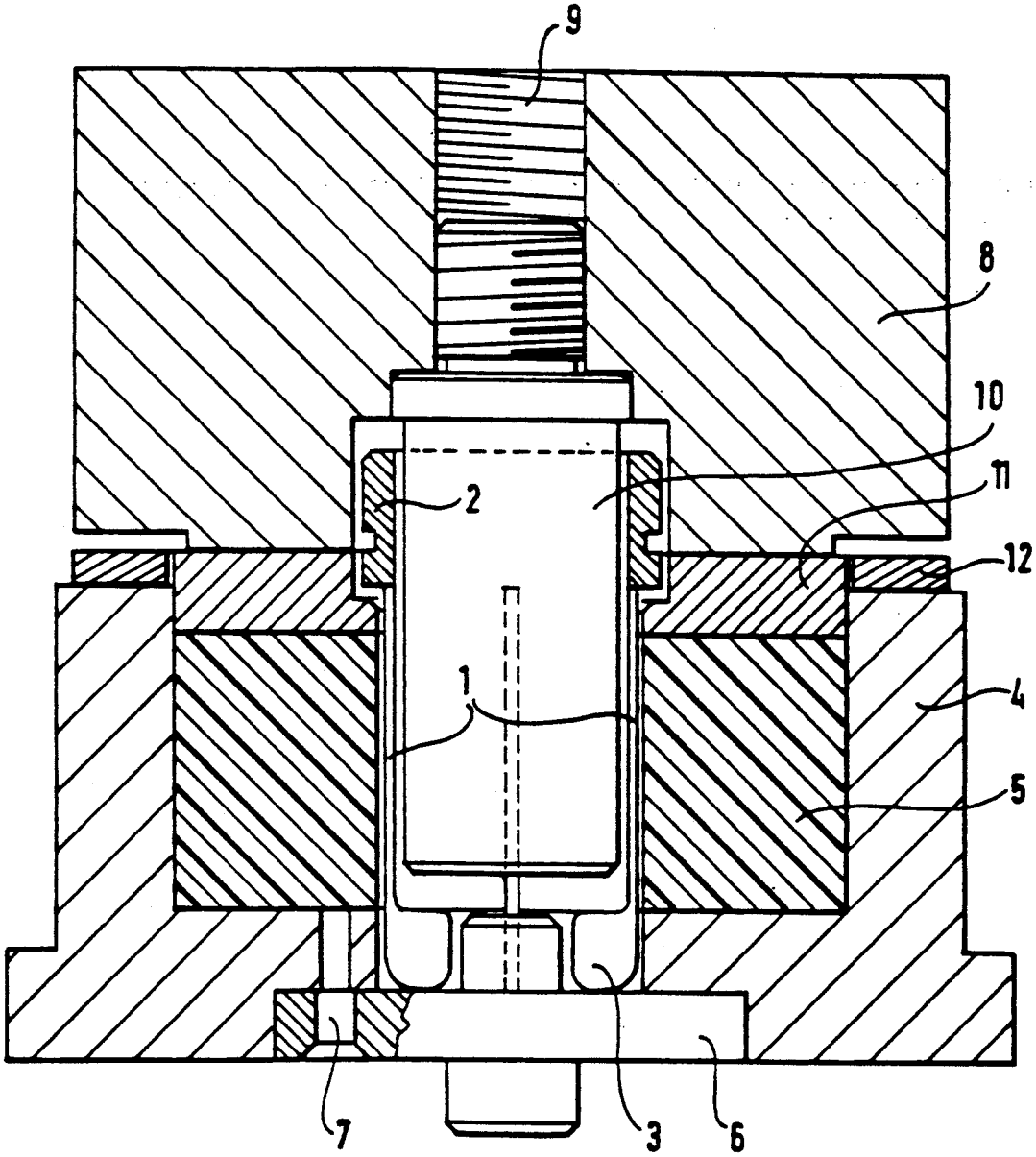
FIG. 1 is an elevation section view of the press shown before swaging the tube.
Figure 2:
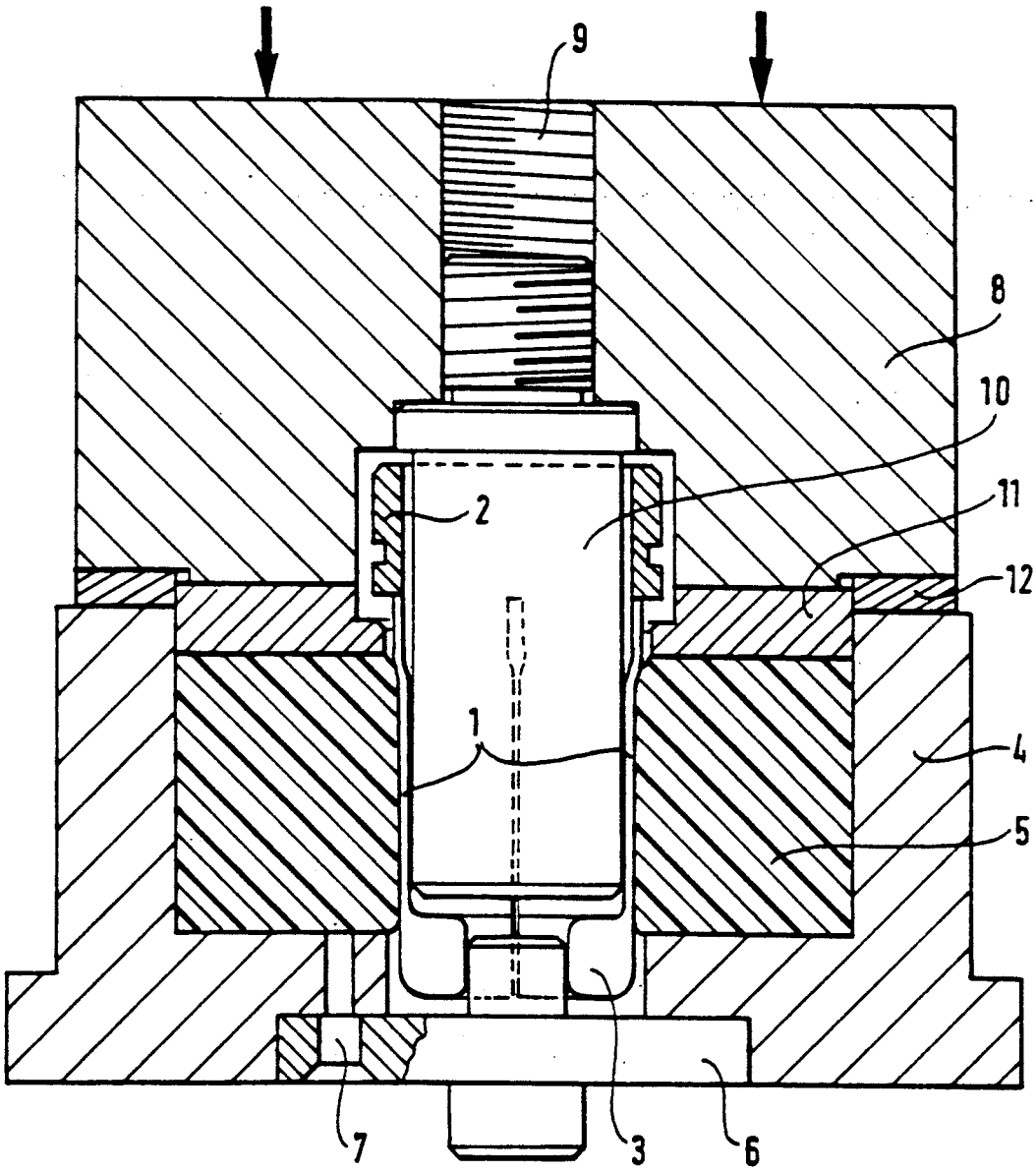
FIG. 2 is a similar view shown after the swaging operation.

In FIG. 1, reference 1 designates a blank for use in making a thimble of contact fingers. The blank is constituted by a tube having one end provided with fluting 2 for securing it in electrical apparatus. The other portion of the tube is thinner and provided with a ring 3, together with parallel longitudinal slots as explained above.

The press for reducing the width of the gap across the slots comprises a sheath 4 preferably made of steel and having a central recess for receiving an annular block 5 made of elastomer. The sheath also includes a bore through its bottom portion for receiving a part 6 that serves to center the blank. This centering part is fixed to the sheath by screws 7.

The press also has a metal top block 8, likewise preferably made of steel, including an axial bore 9 which is partially tapped to receive a core 10 which fits with a given amount of clearance inside the blank 1. Means (not shown) serve to exert pressure on the top face of the block 8 which is transferred by a thrust washer 11 to the block of elastomer. The block deforms and swages the blank around its slots which become narrower as desired. An annular spacer 12, preferably made of steel, serves to limit the stroke of the top block 8, thereby enabling the desired accuracy to be achieved.

The material selected for making the deformable block is advantageously an elastomer sold under the trademark Eladip and having a hardness of 81 on the Shore A scale.

By way of example, to make a thimble having a diameter of 35 mm, the force exerted on the top block is 50 metric tons.

Naturally, the invention is not limited to using the above-specified material nor is it limited to using the press as described, both of which are given merely by way of nonlimiting example.

We claim:

1. A method of manufacturing a thimble of contact fingers from a blank constituted by a tube of material having good conductive properties and good elasticity, said tube including a thin-walled portion provided with longitudinal parallel slots and terminated by a ring of material having good electrical conductivity and being capable of withstanding the effects of electrical arcing, said method comprising the following steps:

placing said blank around a cylindrical core of a diameter substantially equal to the diameter of the blank and of a length equal to the length of the blank with the end of the core placed in abutment against the ring;

disposing an annular block of an elastomer material around the blank over the slots with the inside diameter of the block being close to and slightly greater than the outside diameter of the blank and the axial length of the block being substantially equal to the axial length of the slots; and exerting pressure on end surfaces of said elastomer material block, and reducing the inside diameter of said elastomer material block until the desired slot width is obtained.

2. A method according to claim 1, performed by a press comprising: a fixed sheath provided with a cylindrical recess sized to the outer diameter of said elastomer material block and receiving the elastomer block and having a bore, a centering part for centering the blank within said bore of said fixed sheath, a moving top block overlying said fixed sheath and fixedly supporting said cylindrical core, and a thrust washer interposed between a bottom surface of the moving top block and an end surface of said elastomer material block proximate thereto and having an outer diameter on the order of said central recess and being received by said cylindrical recess, wherein pressure is exerted on said moving top block and transmitted through said thrust washer against said elastomer material block and said centering part centers the blank during deformation of the block, whereby reduction of the inside diameter of the elastomer material block deforms and swages the blank around said slots to narrow the slots to the desired extent.

3. A method according to claim 2, further comprising the step of disposing a spacer between the sheath and the moving top block to limit the stroke of the moving top blank and the extent of deformation of said annular block of elastomer material.

4. A method according to claim 1, wherein the elastomer material of the block is formed of a material sold under the trademark ELADIP, having a Shore A hardness of 81.

* * * * *